US005913303A

United States Patent [19]

Kotsiopoulos

[11] Patent Number: 5,913,303

[45] Date of Patent: Jun. 22, 1999

[54] TRIGGER MECHANISM FOR COMPRESSED GAS POWERED WEAPONS OR THE LIKE

[76] Inventor: Thomas G. Kotsiopoulos, 404 Hillcrest, Prospect Heights, Ill. 60070

[21] Appl. No.: 08/955,047

[22] Filed: Oct. 21, 1997

[51] Int. Cl.[6] ..... F41A 19/00

[52] U.S. Cl. ..... 124/31; 124/72; 124/73; 124/74; 42/42.01; 42/42.03

[58] Field of Search ..... 124/31, 71, 72, 124/73, 74, 75, 76; 42/42.01, 42.03, 43, 69.01; 89/139

[56] References Cited

U.S. PATENT DOCUMENTS

| | | | |
|---|---|---|---|
| 2,398,813 | 4/1946 | Swisher | 35/25 |
| 2,817,328 | 12/1957 | Gale | 124/73 |
| 3,572,310 | 3/1971 | Chiba | 124/73 |
| 4,616,622 | 10/1986 | Milliman | 124/73 |
| 4,819,610 | 4/1989 | Lacam et al. | 124/75 |
| 4,936,282 | 6/1990 | Dobbins et al. | 124/74 |
| 5,063,905 | 11/1991 | Farrell | 124/72 |
| 5,224,465 | 7/1993 | Milliman | 124/76 |
| 5,257,614 | 11/1993 | Sullivan | 124/73 |
| 5,265,582 | 11/1993 | Bhogal | 124/73 |
| 5,280,778 | 1/1994 | Kotsiopoulos | 124/73 |
| 5,349,938 | 9/1994 | Farrell | 124/73 |
| 5,477,843 | 12/1995 | Kunimoto | 124/73 |
| 5,494,024 | 2/1996 | Scott | 124/73 |
| 5,505,188 | 4/1996 | Williams | 124/74 |
| 5,509,399 | 4/1996 | Poor | 124/76 |
| 5,515,838 | 5/1996 | Anderson | 124/76 |
| 5,572,982 | 11/1996 | Williams | 124/74 |
| 5,613,483 | 3/1997 | Lukas et al. | 124/73 |
| 5,634,456 | 6/1997 | Perrone | 124/76 |
| 5,711,286 | 1/1998 | Petrosyan | 124/73 |

*Primary Examiner*—J. Woodrow Eldred
*Attorney, Agent, or Firm*—Leydig, Volt & Mayer, Ltd.

[57] ABSTRACT

A compressed gas powered gun includes a firing system capable of achieving increased firing rates. The firing system includes a regulating system by which an air or firing chamber can be charged with compressed gas from a compressed gas source to a predetermined pressure very rapidly. The firing system also includes a trigger mechanism which enables rapid actuation of a trigger by a user.

12 Claims, 6 Drawing Sheets

TRIGGER MECHANISM FOR COMPRESSED GAS POWERED WEAPONS OR THE LIKE

FIELD OF THE INVENTION

This invention generally relates to a trigger mechanism, and more particularly, to a trigger mechanism for use in compressed gas powered weaponry or the like.

BACKGROUND OF THE INVENTION

A variety of different types of weaponry which utilize discharged compressed gas to fire projectiles are known. These compressed gas powered weapons have particular use in a variety of applications including tranquilizer guns and pellet marking guns which are sometimes referred to as "paint ball guns." Generally marking guns use compressed gas to fire a relatively fragile projectile which comprises a frangible shell which is filled with a marking composition. The capsules are designed to break upon impact with a target and thereby discharge the marking material onto the target.

Such marking guns have a variety of different uses. For example, they may be employed to segregate livestock within a herd, assist in the counting of wild animals or for training of military or law enforcement personnel through simulation exercises. Likewise, they may be used by military and law enforcement personnel for crowd control. Another very popular use for such marking guns is for recreation. In particular, paint ball marking guns are used for "war games" in which participants attempt to hit other combatants with paint balls thereby marking them and eliminating them from the game.

One attribute which is extremely important to users of paint ball marking guns which are intended for such recreational war games, as well as those used for other purposes, is the rate at which the gun may be fired. Obviously, paint ball marking guns which are capable of increased firing rates offer the user a significant competitive advantage over his/her fellow combatants. One significant factor which influences the firing rate of any weapon is the type of firing arrangement that is employed. Paint ball marking guns typically may employ manual, semi-automatic and fully automatic firing arrangements. A manual firing arrangement requires appropriate manipulation of the gun before successive projectiles are fired. In contrast, a semi-automatic firing arrangement enables a projectile to fired each time the trigger is depressed, while an automatic firing arrangement will fire multiple projectiles each time the trigger is pulled.

Although fully automatic weapons may seem desirable, they suffer from various shortcomings. For example, they consume increased amounts of both ammunition and compressed air and have proven problematic, particularly due to feeding mechanism failure. Moreover, they have not achieved widespread success due to regulation prohibiting their use in many recreational settings.

One important limitation on the firing rate is the physical limitations on the speed at which a user can successively pull the trigger. Specifically, even if a weapon is capable of handling much higher firing rates, a user may not be able to achieve these higher firing rates because he/she simply cannot successively pull the trigger fast enough. This limitation is of particular importance in the context of semi-automatic firing arrangements which are generally preferred in most paint ball competitive tournaments since fully the rules typically do not permit automatic firing systems.

OBJECTS OF THE INVENTION

Accordingly, in view of the foregoing, it is a general object of the present invention to provide a trigger mechanism for a weapon which enables rapid actuation of trigger by a user.

Another object of the present invention is to provided a trigger mechanism for compressed gas powered weapons which provides excellent performance and is very easy to maintain.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Generally, the present invention relates to a firing system for a compressed gas powered weapon or the like which is capable of being operated at increased firing rates as compared to known firing systems. These increased firing rates are achieved through a novel trigger mechanism which is incorporated into the firing system of the present invention and which helps a user overcome physical limitations which otherwise prevent the user from achieving increased firing rates. In particular, the trigger mechanism actually assists the user in successively actuating the trigger to thereby take advantage of the increased firing rates achieved by the firing system of the present invention.

In one preferred embodiment, the firing system also includes a compressed gas regulating system which enables an air chamber such as a firing chamber of a compressed gas powered weapon to be rapidly filled to a preselected pressure from a compressed gas source having a pressure higher than the preselected pressure. This invention is also disclosed in patent application Ser. No. 08/955,187, filed on the same date as the present application, entitled "Pressure Regulating System For Compressed Gas Powered Weapons Or The Like," and is incorporated herein by reference in its entirety. In the context of a compressed gas powered weapon, such rapid filling or charging of the firing chamber allows the weapon to achieve increased firing rates without adversely affecting the accuracy of the gun.

While the present invention is described in connection with a compressed gas powered gun, which has particular use a paint ball marking gun, it will be readily appreciated that the teachings of the present invention can also be applied in other contexts. These include, for example, other types of compressed gas powered weapons. The regulating system of the present invention may be utilized in many applications other than compressed gas powered weapons. In particular, the regulating system may be employed in any application where it is desirable to rapidly fill a chamber with a compressed gas to a preselected pressure. Similarly, it will be appreciated that the trigger mechanism of the present invention could be utilized in weapons other than simply compressed gas powered weapons.

Figure 2:
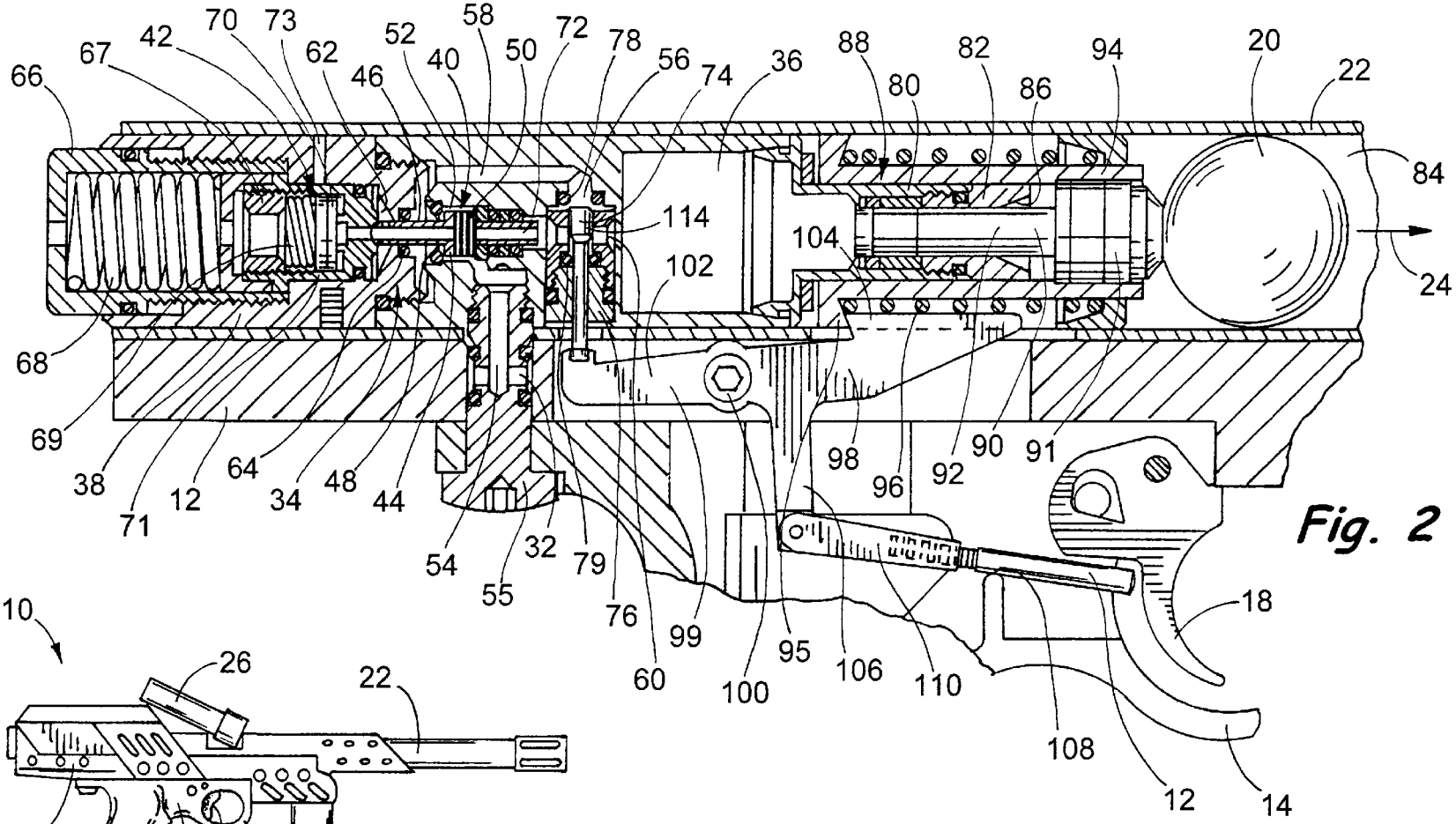
FIG. 2 is a partial side sectional view of the compressed gas powered gun of FIG. 1, taken axially through the gun, showing the firing system in a ready-to-fire mode.
Figure 1:
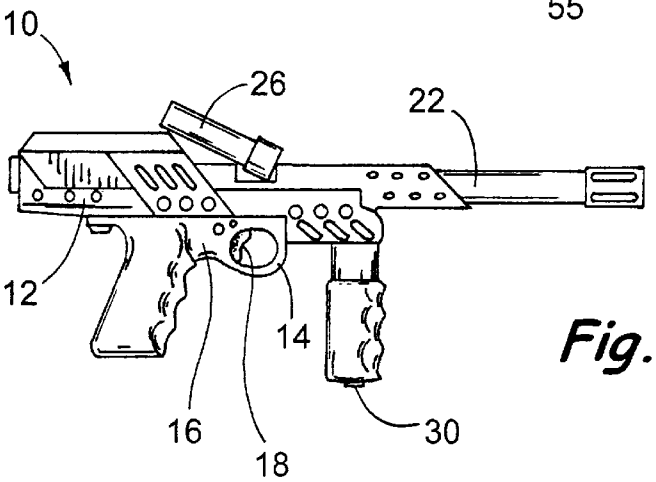
FIG. 1 is a side view of a compressed gas powered gun that utilizes the teachings of the present invention.

FIGS. 1–6 illustrate one preferred embodiment of a compressed gas powered gun which incorporates the firing system of the present invention. Certain details of the gun are also disclosed in U.S. Pat. No. 5,280,778, which is incorporated herein by reference in its entirety. As best shown in FIG. 1, the gun 10 comprises a longitudinally extending frame support or rail 12 with a trigger-guard 14 and handle 16 depending therefrom. A pivotally mounted trigger 18, the operation of which is described in more detail below, is disposed within the trigger-guard 14. The firing system is operable in a firing mode wherein a projectile is expelled from the gun and a ready-to-fire or reloading mode which places the gun in condition for firing. As seen in FIG. 2, a projectile 20, such as a marking pellet or paint ball, exits an elongate, generally cylindrical barrel 22 in the direction of arrow 24 during the firing mode. An ammunition feeding tube 26 (FIG. 1) is disposed to supply a plurality of projectiles in a manner in which the projectiles are fed to the gun, one at a time, as will be understood by those skilled in the art.

For providing connection of the gun to a source of compressed gas, the gun includes an inlet port 30 which in the preferred embodiment comprises a conventional adapter which allows an air line or hose (not shown) to be quickly and easily connected and disconnected from the gun. The source of the compressed gas preferably comprises a tank of compressed air (not shown) as will be understood by those skilled in the art. In order to provide for ease of movement, the compressed air tank could be strapped to the back of the user or could carried on a belt. The compressed gas source preferably is supplied at a pressure of approximately 700 pounds per square inch (psi). Of course, it should be appreciated that different types of sources of compressed gas could be used with the present invention. In addition, while compressed air is preferred, other compressed gases such as nitrogen may be used.

The compressed gas or air passes from the inlet port 30 via an annular inlet passageway 32 which, in the illustrated embodiment, extends along the rail of the frame 12. This inlet passageway provides a passageway to a compressed gas delivery system which operates to control and meter the compressed gas received from the compressed gas source in both the firing and ready-to-fire modes of the firing system. Specifically, the compressed gas delivery system includes a pressure regulating system or assembly 34 and a fluid pathway which interconnects the compressed gas inlet port 28 with an air or firing chamber 36.

In accordance with one aspect of the present invention, a pressure regulating assembly is adapted to rapidly recharge the firing chamber after it is expelled by filling at an increased pressure until a preselected pressure is attained. In the illustrated embodiment, the pressure regulating assembly 34 is adapted to operate at a very high speed and provide for full pressure recharge of the firing chamber 36. This results in the firing chamber 36 being charged with compressed gas to the preselected pressure very rapidly thereby increasing the potential firing rate of the gun 10.

The pressure regulating assembly 34 and the fluid pathway are disposed in a cylindrical terminal housing or valve body section 38 of the gun. The regulating assembly 34 generally comprises a screw-type control and valve arrangement including a valve 40 disposed in the fluid pathway interconnecting the inlet port 30 and the firing chamber 36 and a regulator piston subassembly 42. The main structural details of the valve 40 include a head portion 44, a valve stem 46, a seat 48 and a biasing spring 50. A generally cylindrical regulator valve chamber 52 is formed in the valve body section 38 of the gun which is in fluid communication with the inlet passageway 32 via a fluid passageway 54 provided in the field strip screw 55. The valve head 44 is contained within the regulator valve chamber 52 while one end of the stem portion 46 extends outwardly to the regulator piston subassembly 42.

Figure 3:
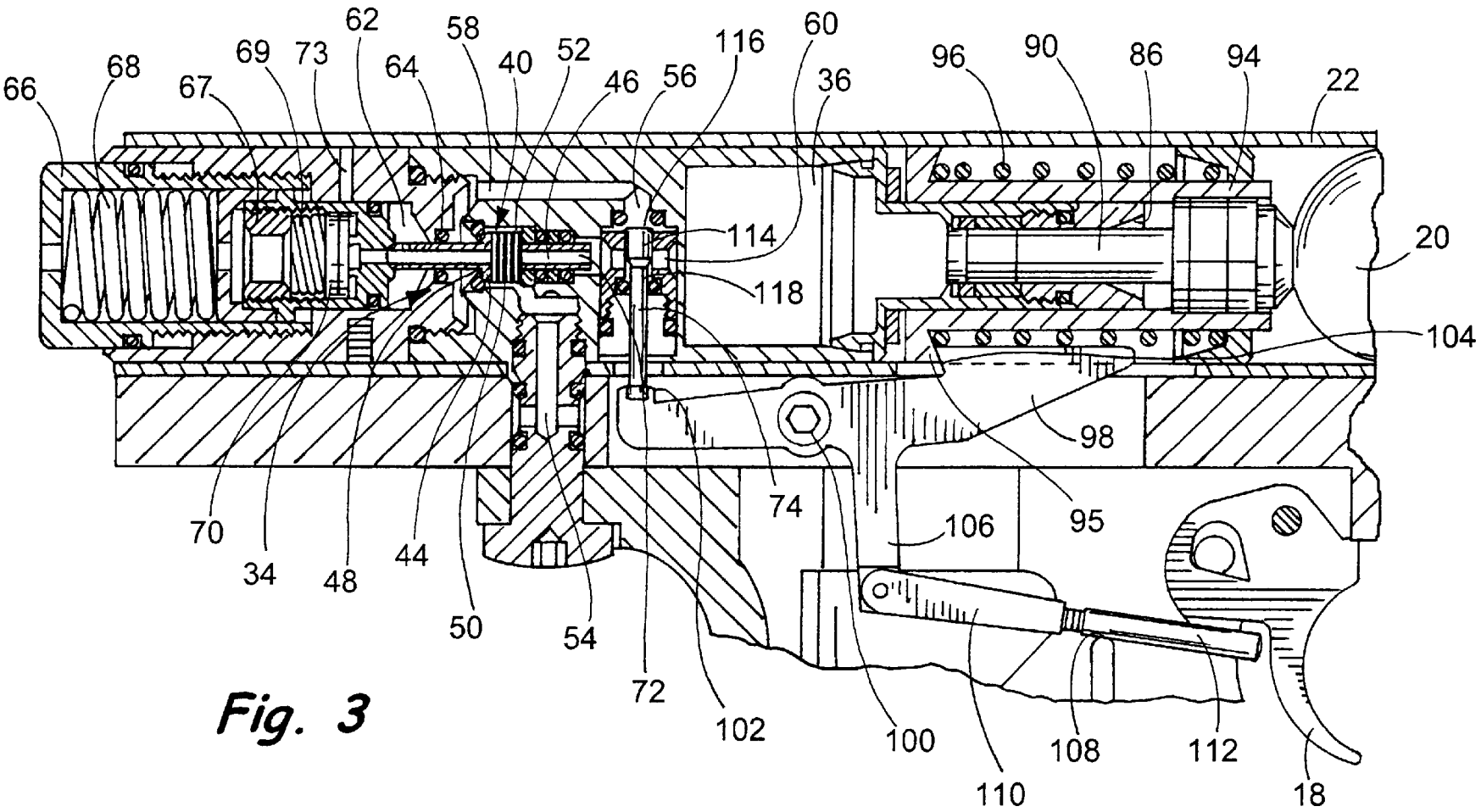
FIG. 3 is also a partial side sectional view taken axially through the compressed gas powered gun, showing the firing system in the ready-to-fire mode with a regulator valve in the closed position.

The valve 40 is operable to move between an open position, wherein compressed gas flows from the inlet port 30 to the firing chamber 36 via the fluid pathway and a closed position, wherein the inlet port 30 is isolated from the firing chamber 36. Specifically, when the valve 40 is in the closed position, the valve head 44 engages the valve seat 48 to thereby close off the flow of compressed gas to the firing chamber 36 as shown in FIG. 3. When the valve 40 is in the open position, compressed gas flows between the outer periphery of the valve head 44 and the walls of the regulator valve chamber 52 as shown in FIG. 2. The flow of compressed gas past the valve 40 continues to an on/off flow valve chamber 56 via a fluid passageway 58. In turn, the flow valve chamber 56 is interconnected with the firing chamber 36 by way of a second fluid passageway 60 which completes the fluid pathway between the inlet port 30 and the firing chamber 36.

In order to control the pressure in the firing chamber 36, the regulator piston subassembly 42 is adapted to move the valve 40 to the closed position (FIG. 3) when a predetermined pressure of compressed gas is sensed and to urge the valve 40 to an open position when a pressure less than the preselected pressure is sensed. The regulator piston subassembly 42 is arranged in a regulator piston bore 62 which is sealed from the flow of gas from the regulator valve chamber 52. In order to prevent gas from leaking into the regulator piston bore, around the valve stem an o-ring seal 64 is provided. The main structural components of the regulator piston subassembly include a threaded adjusting nut 66, a biasing spring 68 and a regulator piston 70.

In the preferred embodiment, a blow off valve arrangement valve is provided which includes a head 67 and biasing spring 69. When an over-pressure condition is sensed, the valve permits the compressed to vent to atmosphere via an overflow port 73.

In order to sense the pressure of the gas in the firing chamber 36, the regulating assembly 34 further includes a sensing line 72. The sensing line 72 is in fluid communication with the regulator piston bore 62 and is adapted to apply the pressure of the gas in the firing chamber 36 to the regulator piston subassembly 42. In a preferred embodiment, the forward end of the valve stem 46 extends to a location adjacent the firing chamber 36 and the sensing line 72 comprises a bore in the valve stem 46 which extends from adjacent the firing chamber 36 to the regulator piston bore 62 as shown in FIGS. 2–6.

When the firing chamber 36 is being filled or charged with compressed gas during the ready-to-fire mode of the firing system, the regulating springs 68, 69 bias the regulator piston 70 toward a forward position in the piston bore 62, which in turn, acts to move the valve head 44 away from the valve seat 48 as best shown in FIG. 2. The regulator piston 70 remains in this forward position and thereby prevents the valve 40 from closing until a predetermined pressure is supplied to the firing chamber 36 and to the piston bore 62 via the sensing line 72. When the pressure in the firing chamber 36 and the piston bore 62 reach the predetermined pressure, as shown in FIG. 3, the regulator piston 70 is moved counter to the force of the regulator springs 68, 69 to a rearward position which causes the valve 40 to engage the valve seat 48 and seal the regulator valve chamber 52. The compressed gas in the portion of the fluid pathway upstream from the valve head 44 and the biasing spring 50 coact to maintain a closure tension on the valve 40.

Figure 5:
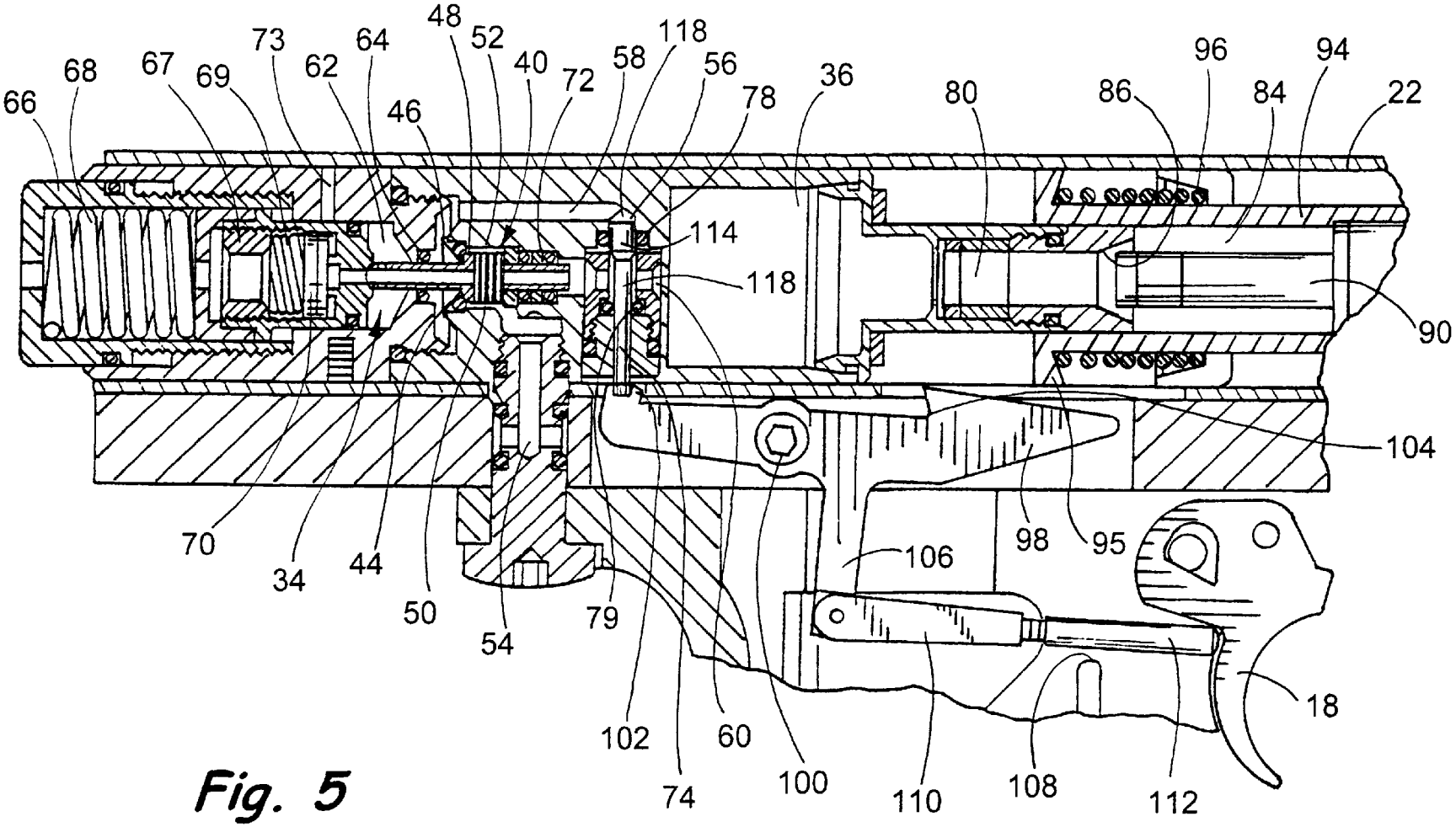
FIG. 5 is a partial side sectional view of the compressed gas powered gun showing the firing system in the firing mode with the trigger fully depressed and the actuating bolt assembly released.
Figure 6:
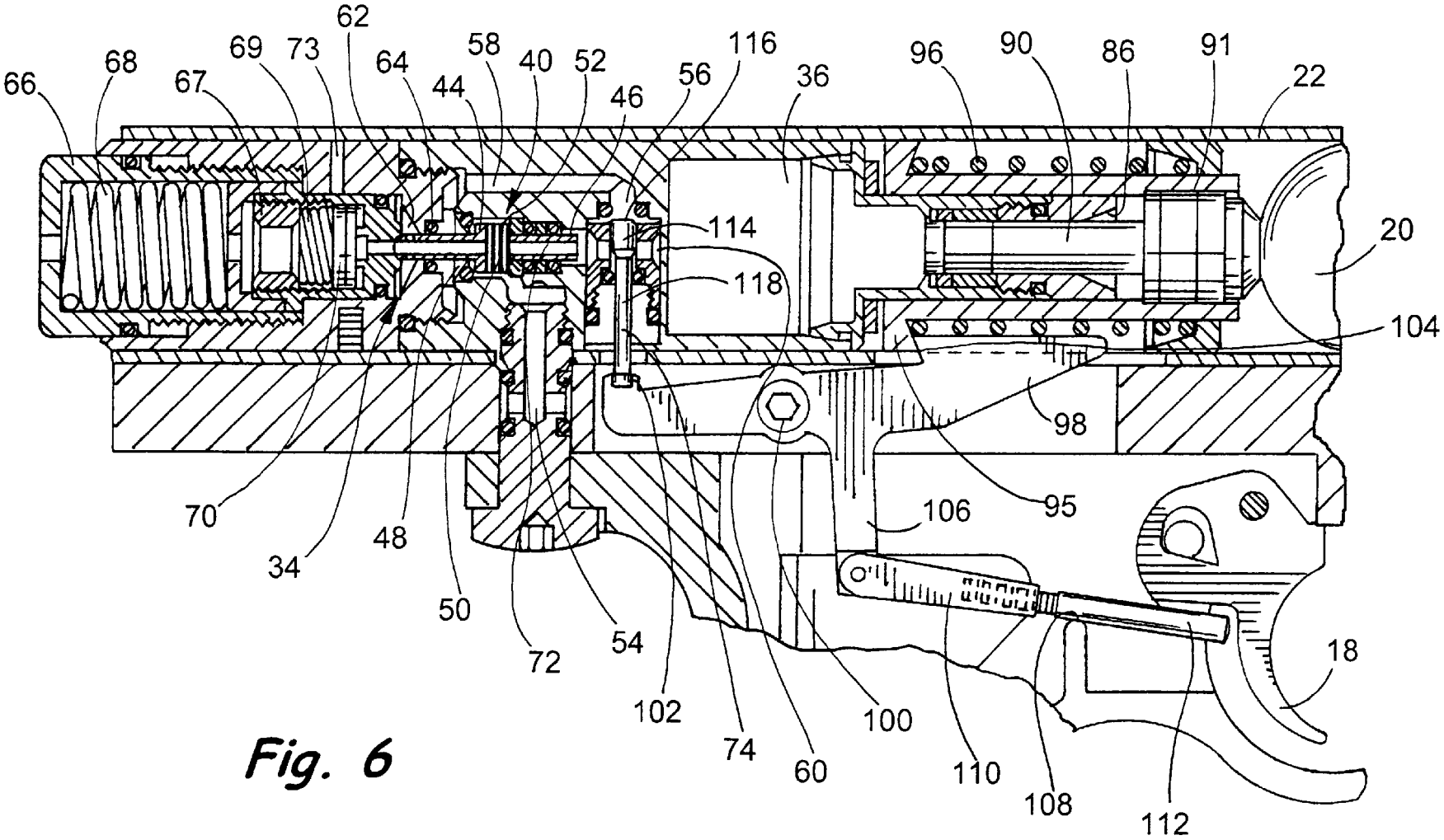
FIG. 6 is a partial side sectional view of the compressed gas powered gun showing the firing system returning to the ready-to-fire mode after execution of a firing sequence.

When the pressure in the air chamber 36 and, in turn, in the regulator piston bore once again falls below the predetermined pressure such as after a firing sequence, the regulating piston subassembly 42 urges the valve 40 to an open position as shown in FIGS. 5–6. Compressed gas supplied to the regulator piston bore 62 via the sensing line 72 thereafter acts against the tension of the regulating springs 68, 69 to move the piston 70 rearward. Thus, compressed gas is again discharged until the pressure in the air chamber 36 reaches the predetermined level sufficient to urge the valve 40 closed.

Figure 7:
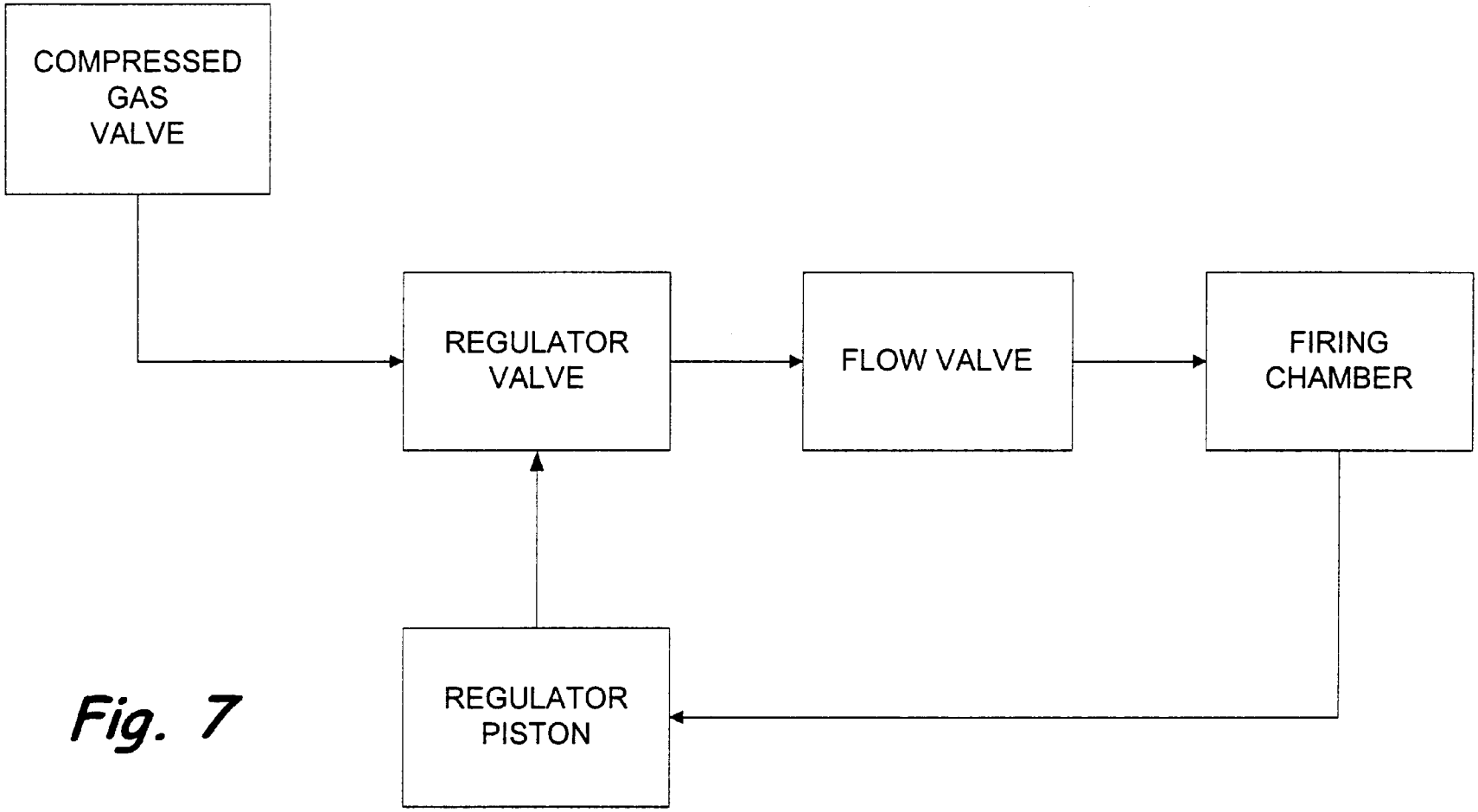
FIG. 7 is a block diagram illustrating the pressure regulating system of the present invention.

The operation of the compressed gas delivery system including the regulating system of the present invention is perhaps best understood by reference to the block diagram of FIG. 7. In contrast to conventional arrangements in which the compressed gas is regulated to a lower pressure as soon as it enters the gun or the compressed gas delivery system, the present invention "regulates" the pressure in the firing chamber 36 itself by shutting of the supply of compressed gas when the firing chamber 36 reaches the desired pressure. Thus, the regulating system of the present invention allows the firing chamber 36 to charge at very nearly the full line pressure of the compressed gas source. As can be appreciated, this allows the firing chamber to fill with compressed gas to the desired pressure much more rapidly than conventional designs. As shown in the block diagram of FIG. 7, this is accomplished, at least in part, by drawing off the compressed gas which acts on the regulator piston 70 from a location adjacent the firing chamber 36. Drawing off, or sensing, the pressure at this point, as opposed to as soon as it passes the valve, eliminates the problem of the flow of gas slowing substantially through a nearly closed regulator valve as the pressure in the system nears the desired pressure. For example, while known regulating systems in compressed gas powered guns limited the firing rate to no more than five rounds per second before the projectile velocity started to drop off, in one preferred embodiment the regulating system of the present invention is capable of achieving a firing rate of twenty-five rounds per second with no velocity drop-off.

This arrangement also ensures precise operation of the gun 10 for successive firings over a wide range of ambient temperatures. For example, when the ambient temperature increases, thereby increasing the gas pressure in firing chamber 36 and the piston bore 62, the regulator piston 70 is urged rearward to close the valve 40. If the ambient temperature increases to a level where the pressure in the piston bore 62 exceeds the desired firing chamber pressure and the gas supply pressure by a sufficient amount, i.e., 650 p.s.i., the overflow valve will move sufficiently rearwardly to permit venting through the port 73. Conversely, when the ambient temperature decreases, thereby decreasing the pressure in the firing chamber 36 and the piston bore 62, the gas supply pressure decreases, urging the valve 40 to an open position. In this way, the pressure regulating assembly 34 operates to maintain a desired pressure supplied to the air chamber 36 for each firing of the gun.

In order to allow for the adjustment of the pressure to which the firing chamber 36 is charged, and thereby the velocity of the projectile 20, means are provided for adjusting the pressure at which the regulator valve 40 closes. Specifically, in the illustrated embodiment, the amount of force exerted by the first regulating spring 68 on the regulating piston 70 can be controlled through manual adjustment of a threaded velocity nut 66 provided on the end of the valve body 38. For example, in order to increase the pressure to which the firing chamber 36 is charged, the velocity nut 66 is turned so as to increase the force that the first regulating spring 68 applies to the regulating piston 70. A relatively higher pressure will then be required to urge the regulating piston 70 rearward and thereby close the valve 40. In a preferred embodiment, the pressure regulating assembly 34 should be set to shut off the flow of compressed gas from the inlet port 30 when the pressure in the air chamber 36 reaches approximately 450 psi.

In order to protect against an over pressure condition in the compressed gas delivery system resulting from a seal failure or the disassembly of the gun when the firing system is under pressure, the blow off valve and over pressure vent 73, discussed above, may also be provided.

It will be appreciated from the foregoing description that the compressed gas delivery system and, in particular, the pressure regulating system of the present invention may also have application outside of the context of compressed gas powered weapons. In fact, the compressed gas delivery system of the present invention could be used in any application where the object is rapidly charging an air chamber with compressed gas to a preselected pressure.

Figure 4:
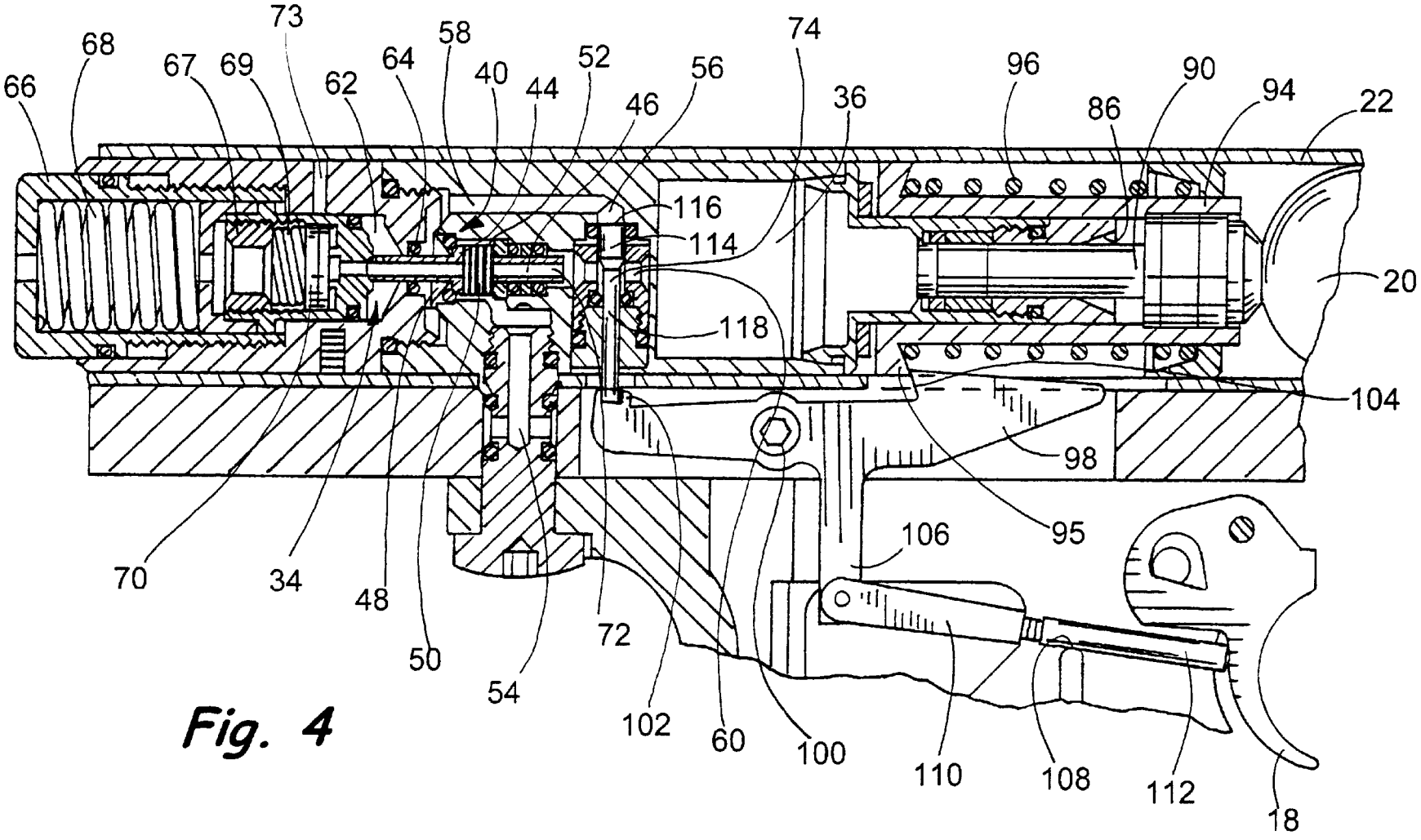
FIG. 4 is a partial side sectional view of the compressed gas powered gun showing the firing system in a firing mode prior to release of an actuating bolt assembly.

In order to ensure that the preselected pressure is maintained in the firing chamber 36 for the firing mode, the firing system further includes a on/off valve 74 which seals off the firing chamber 36 from the compressed gas source when the firing system is operating in the firing mode. The on/off flow valve 74 is movable between open and closed positions and, in particular, is operable to open and thereby permit fluid communication between the firing chamber 36 and the inlet port 30 in the ready-to-fire mode of operation, as shown in FIG. 2. This enables the firing chamber 36 to be charged with compressed gas to the predetermined pressure via the compressed gas delivery system during the ready-to-fire mode. In the firing mode of operation, the on/off flow valve 74 closes thereby isolating the firing chamber 36 from the inlet port 30 and the compressed gas source, as shown in FIG. 4. This isolation of the firing chamber 36 from the compressed gas source prevents compressed gas from flowing into the firing chamber to replace the air which has been discharged from the firing chamber in order to expel the projectile. This is of particular importance because the pressure in the regulator piston bore 62 has dropped resulting in the opening of the regulator valve 40. As shown in FIGS. 2 and 4–6, the on/off flow valve 76 is movable transversely relative to the longitudinal axis of the gun between the open and closed positions. In order to prevent compressed gas from leaking past the on/off flow valve when it is in the closed position, an o-ring seal 78 is provided adjacent the upper end of the flow valve chamber 56. In addition, a second o-ring seal 79 is provided adjacent the lower end of the flow valve chamber to prevent compressed gas from leaking out of the compressed gas delivery system.

The air or firing chamber 36 supplies the compressed gas that expels the projectile through the barrel 22 when the firing system is in the firing mode. The air chamber 36 is defined by a bore formed in the main body portion of the gun 10 terminating at one end with an intermediate firing tube or power tube 80. An annular sleeve 82 interfits within the power tube 80 and, along with the power tube 80, defines a discharge path for compressed air contained in the firing chamber 36 to blast into a breech 84 of the gun 10. The annular sleeve 82 includes a tapered portion 86 that further defines a passage for the blast of compressed gas. This tapered portion 86 on the power tube 80 is configured such that the air flows out of the air chamber 36 and the power tube at a controlled rate which prevents relatively fragile projectiles such as paint balls from breaking as a result of too much pressure building up behind the paint ball. Inasmuch as the pressure supplied to the firing chamber 36 has been substantially reduced from the maximum available pressure from the compressed gas source, the volume defined by the firing chamber 36 is substantially larger than found in many known arrangements.

The blast of compressed gas exits the air chamber 52 upon actuation of a bolt assembly 88 which includes a power piston 90. The power piston 90 comprises head and body sections 91 and 92, respectively, with the body section 92 being sized to fit within the annular sleeve 82 and power tube 80. FIG. 2 best illustrates the remaining structural features of the bolt assembly 88, including a cylindrical actuating bolt 94 disposed in surrounding relation to the annular sleeve 82 and power tube 80. The actuating bolt 94 includes a protruding dog portion 95 disposed at one of its ends. A recoil spring 96 retracts the actuating bolt 94 against a bumper 97 when the actuating bolt 94 is returned to a ready-to-fire position.

As described in detail in said U.S. Pat. No. 5,280,778, the bolt assembly 88 is maintained in a ready-to-fire position with the use of a trigger mechanism which includes a sear 98 having an arm 99 that is rotatable about a pivot 100, which in a preferred embodiment comprises a threaded roller bearing axle. The arm 99 has a transversely extending actuating member 101 at one end, located on one side of pivot 100, and an interlocking element 104 at the other end, located on the other side of the pivot 100. The actuating member 102 is generally aligned with the on/off flow valve 74. The interlocking element 104 includes a notched portion that engages the dog portion 95 of the actuating bolt 94 in the ready-to-fire position. The interlocking element 104 preferably also includes an elongated portion extending substantially along the path of travel of the actuating bolt assembly 88 to provide a stop surface that prevents the actuating bolt assembly from engaging the interlocking element 104 during recoil of the actuating bolt assembly.

An actuating lever 106 projects transversely on the side of the latch arm 99 opposite the actuating member 102 and the interlocking element 104. A sliding trigger arm 108 disposed within the handle 16 operates to transmit force from the trigger 18 to the actuating lever 106. As explained in detail in said U.S. Pat. No. 5,280,778, this provides for semi-automatic firing of the gun 10 in operation. In the illustrated embodiment, the trigger arm 108 comprises a first link 110 which is pivotally connected to the actuating lever 106 and a second link 112 which is threaded into the first link. With this arrangement, any play in the trigger mechanism can be selectively adjusted merely by turning the second link 112 relative to the first link 110 and thereby thread the second link further out of or in to the first link.

In accordance with another important feature of the present invention, the trigger mechanism may be configured such that a user's finger is "pushed back" after the gun 10 is fired through the execution of a pull stroke of the trigger 18. This provides the sensation of a "reactive trigger." The pushing back of the finger after the trigger 18 is actuated or pulled to fire the gun 10 helps the user pull the trigger in more rapid succession, thereby helping the user to achieve an increased firing rate. The trigger mechanism is operable to actuate the firing system from the ready-to-fire mode to the firing mode to fire the gun upon the execution of a pull stroke of the trigger 18 and from the firing mode back to the ready-to-fire mode to place the gun back in condition for firing upon the execution of a return stroke of the trigger 18. The pushing back of the user's finger after the gun is fired is accomplished by increasing the force applied through the trigger mechanism on the trigger 18, and counter to which the trigger must be pulled to fire the gun, immediately after the gun is fired. Since a lesser force is necessary to pull the trigger 18, this increase in the force opposing the trigger pull has a tendency to force the trigger 18 through the return stroke even if the user has not sufficiently released the trigger. Once the gun 10 is urged back in condition for another firing sequence, the force applied on the trigger 18 through the trigger mechanism is reduced in order to enable the trigger to be manually pulled with greater ease.

In the illustrated embodiment of the invention, an increased force applied on the trigger after the gun is fired is accomplished by configuring the on/off flow valve 74 with a differential piston head 114. The differential head 114 of the flow valve comprises a first portion 116 with a relatively larger effective surface area and a second portion 118 with a relatively smaller surface area. Thus, when the flow valve 74 is open, the system relies on the second portion 118 of the differential piston since as the effective area to which the pressure is applied. This results in a relatively smaller force being applied to the on/off flow valve 74 by the compressed gas in the system when the flow valve is moving to the closed position as compared to the force applied on the on/off flow valve 74 as it moves to the open position. As the differential piston head 114 is moved toward the O-ring seal 78, the system relies on the force applied to the lesser diameter portion 118 to provide resistance to the trigger pull.

On the other hand, when the air chamber has expelled and the differential piston head 114 is in engagement with the upper O-ring seal 78, the force applied to the system is transferred to the larger first portion 116 of the piston head 114. At this point, the gas from flow chamber beneath the head 114 has expelled. Likewise, the regulator valve 40 opens and the system upstream from the on-off valve goes to the full line pressure of the compressed gas source. This slams the on-off valve back to the open position with greater force than applied to the valve when moved from the open position to the closed position. Once returned to the open position, i.e, when the larger diameter head 114 is disengaged from the O-ring seal 78, the effective area of the on-off valve upon which the pressure acts is once again the smaller diameter piston head 116.

Specifically, as the first step of the firing sequence, the trigger 18 is pulled and the resultant longitudinal movement of the trigger arm 108 acts to rotate the actuating lever element 106 of the sear in a clockwise direction (relative to FIGS. 2–6) which in turn rotates the sear arm 99 in the clockwise direction. As shown in FIG. 4, the rotation of the sear arm 99 forces the on/off flow valve 74 into the closed position in response to the movement of the actuating member 102. This movement of the flow valve 74 into the closed position is resisted by the downward force (relative to FIGS. 2–6) exerted on smaller second portion 118 of the differential piston head on the flow valve 74 by the compressed gas in the system.

As shown in FIG. 5, once the on/off flow valve 74 has closed, the interlocking element 104 on the sear 98 releases the dog portion 95 of the actuating bolt and the compressed gas in the firing chamber 36 moves the power piston 90 rapidly forward and is released from the power tube 80 resulting in the discharge of the projectile 20 from the barrel 22. Upon the release of the compressed gas in the firing chamber 36, the compressed gas in the regulator piston bore 62 is also released via the sensing line 72 resulting in movement of the regulator valve 40 back into the open position. After the gun 10 has been fired, the gas pressure maintained in the system upstream from the on/off flow valve 74 continues to exert a downward force on the on/off flow valve. However, since all of the compressed gas downstream from the on/off flow valve 74 has been discharged, the effective area on which it acts is the larger first portion of the differential piston head. Thus, the force acting on the flow valve 74, and in turn on the trigger 18 through the sear 98, is increased immediately after the compressed gas is discharged from the firing chamber 36. Since the force now applied on the trigger 18 is greater than the force that had to be overcome to pull the trigger, this force tends to force a user to release the trigger 18 and allow the firing system to return to the ready-to-fire mode. In one preferred embodiment, it takes approximately 4 lbs. to pull the trigger and as soon as the gun is fired the force increases to 8 lbs. It has been found that this "reactive trigger" can enable a user to increase his or her firing rate by approximately thirty-three percent over conventional trigger arrangements.

In addition, upon the release of the compressed gas in the firing chamber 36, the recoil spring 96 drives the actuating bolt 94 rearwardly against the bumper 97 where it is held in place by the force of the recoil spring. The increased downward force exerted on the on/off flow valve 74 will force the trigger 18 through the return stroke. In particular, the force on the on/off flow valve 74 moves the actuating member 102 of the sear to effect slight counterclockwise rotation of the sear 98 to both open the on/off flow valve 74 and to latch the actuating bolt 94 with the interlocking element 104. The firing chamber is then recharged to the desired pressure via the compressed gas delivery system as described above.

The differential between the force applied on the trigger 18 during the pull stoke and the force applied during the return stroke is further accentuated by the regulating system of the present invention. Particularly, as soon as the regulator valve 40 reopens because of the discharge of gas from the firing chamber 36, the pressure in the portion of the compressed gas delivery system upstream from the on/off flow valve 74 increases from the regulated pressure to the full line pressure of the compressed gas source. This increase in the pressure results in a greater downward force being applied to the on/off flow valve 74. Of course, it will be appreciated that the advantages of the differential head on/off flow valve of the present invention could be achieved in firing systems which do not utilize the regulating system disclosed herein. Moreover, it will be appreciated that the teachings of the trigger mechanism of the present invention could also be applied to weapons other than the compressed gas powered gun disclosed herein. That is, the invention may be incorporated in any device actuated by hand manipulation with the use of a differential force transmission arrangement which is operable to apply a relatively greater force during a return stroke of the device than the force applied during the actuating stroke.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A compressed gas firing system operable in a first mode to discharge a projectile from a barrel of a gun or the like and a second mode to reload the gun, the firing system being powered by a compressed gas source which provides compressed gas at an inlet, the firing system comprising:

a firing chamber disposed for receiving compressed gas from the compressed gas source for supplying compressed gas to expel the projectile through the barrel when the firing system is in the first mode;

a flow valve disposed between the inlet and the firing chamber, the flow valve being movable between an open position in the first mode of the firing system wherein compressed gas is permitted to flow from the compressed gas source to the firing chamber and a closed position in the second mode of the firing system wherein the firing chamber is isolated from the gas source so as to maintain a preselected pressure in the firing chamber;

an actuating assembly operable to seal the firing chamber when the firing system is in the second mode and to direct compressed gas discharged from the firing chamber toward the projectile when the firing system is in the first mode;

a trigger assembly including a trigger movable through a pull stroke and a return stroke, the trigger assembly being operable to hold the actuating assembly when the firing system is in the second mode when the trigger is fully released and to actuate the firing system from the second mode to the first mode when the trigger is moved through the pull stroke; and the flow valve being configured and operable through the trigger assembly so as to apply a first force counter to which the trigger is moved during the pull stroke and to apply a second force on the trigger during the return stroke, the second force being greater than the first force and operable to move the trigger through the return stroke and the flow valve to the open position.

2. The firing system of claim 1 wherein the flow valve is configured with a differential piston head.

3. The firing system of claim 2 wherein the differential piston head comprises a first portion with a relatively larger effective surface area and a second portion with a relatively smaller effective surface area.

4. The firing system of claim 1 further including a pressure regulating assembly including a regulator valve disposed between the inlet and the flow valve and operable to move between an open position wherein gas from the compressed gas source can flow to the firing chamber and a closed position wherein the compressed gas source is isolated from the firing chamber, a sensing line for sensing the pressure of the compressed gas in the firing chamber and a regulator in fluid communication with the sensing line and adapted to move the regulator valve to the closed position when a preselected pressure of compressed gas is sensed and to move the valve to the open position when a pressure less than the preselected pressure is sensed.

5. The firing system of claim 4 wherein the pressure regulating assembly further includes a valve stem which couples the regulator and the valve.

6. The firing system of claim 5 wherein the valve stem extends to a point adjacent the chamber and wherein the sensing line is a bore extending through the valve stem from a first location adjacent the gas chamber to a second location inside a chamber containing the regulator.

7. A flow valve for use in a firing system of a compressed gas powered gun, the firing system being powered by a compressed gas source arranged to provide compressed gas at an inlet, the firing system including a trigger mechanism actuatable between a firing mode to fire the weapon and a ready-to-fire mode to place the gun in condition for firing, an air chamber for supplying compressed gas to expel a projectile when the trigger mechanism is in the firing mode, and a trigger for movable through a pull stroke which operates to actuate the trigger mechanism from the ready-to-fire mode to the firing mode and a return stroke which operates to actuate the trigger mechanism from the firing mode back to the ready-to-fire mode, the flow valve being:

disposed between the inlet and the firing chamber and movable between an open position wherein compressed gas is permitted to flow to from the compressed gas source to the firing chamber when the trigger mechanism is in the ready-to-fire mode and a closed position wherein the firing chamber is isolated from the compressed gas source when the trigger mechanism is in the firing mode; and the flow valve being configured to apply through the trigger mechanism a first force on the trigger counter to which the trigger must be moved during the pull stroke and to apply through the trigger mechanism a second force greater than the first force on the trigger during the return stroke.

8. The flow valve of claim 5 wherein the flow valve is configured with a differential piston head.

9. The flow valve of claim 6 wherein the differential piston head comprises a first portion with a relatively larger effective surface area and a second portion with a relatively smaller effective surface area.

10. A method for increasing the rate at which a weapon may be fired through manual operation of a trigger of a trigger mechanism, the trigger mechanism being actuatable between a firing mode to fire the weapon and a ready-to-fire mode to place the weapon in condition for firing, the trigger being movable through a pull stroke which operates to actuate the trigger mechanism from the ready-to-fire mode to the firing mode and through a return stroke which operates to actuate the trigger mechanism from the firing mode back to the ready-to-fire mode, the method comprising the steps of:

applying through the trigger mechanism a first force on the trigger during the pull stroke counter to which the trigger must be pulled in order to actuate the trigger mechanism from the ready-to-fire mode to the firing mode;

increasing the force applied by the trigger mechanism on the trigger immediately after the trigger mechanism operates to fire the weapon.

11. A trigger mechanism for a weapon which increases the rate at which the weapon may be fired through manual operation of a trigger, the trigger mechanism being actuatable between a firing mode to fire the weapon and a ready-to-fire mode to place the weapon in condition for firing, the trigger being movable through a pull stroke which operates to actuate the trigger mechanism from the ready-to-fire mode to the firing mode and through a return stroke which operates to actuate the trigger mechanism from the firing mode back to the ready-to-fire mode, and the trigger mechanism being adapted apply a first force on the trigger counter to which the trigger must be moved during the pull stroke and to apply a second force greater than the first force on the trigger during the return stroke.

12. The trigger mechanism of claim 11 further including a differential force transmission arrangement configured and operable through the trigger mechanism so as to apply the first force on the trigger during the pull stroke and to apply the second force on the trigger during the return stroke.

* * * * *